US011054774B2

(12) United States Patent
Takahashi et al.

(10) Patent No.: US 11,054,774 B2
(45) Date of Patent: Jul. 6, 2021

(54) NIP FORMING MEMBER, FIXING DEVICE, AND IMAGE FORMING APPARATUS

(71) Applicants: Yoshiharu Takahashi, Kanagawa (JP); Naoki Iwaya, Tokyo (JP); Hitoshi Fujiwara, Tokyo (JP); Ippei Fujimoto, Tokyo (JP); Yoshiki Yamaguchi, Tokyo (JP)

(72) Inventors: Yoshiharu Takahashi, Kanagawa (JP); Naoki Iwaya, Tokyo (JP); Hitoshi Fujiwara, Tokyo (JP); Ippei Fujimoto, Tokyo (JP); Yoshiki Yamaguchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/811,955

(22) Filed: Mar. 6, 2020

(65) Prior Publication Data

US 2020/0285182 A1 Sep. 10, 2020

(30) Foreign Application Priority Data

Mar. 7, 2019 (JP) ..... JP2019-041223

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2064; G03G 2215/2022; G03G 2215/2025; G03G 2215/2035
See application file for complete search history.

(56) References Cited

U.S. PATENT DOCUMENTS

| | | | |
|---|---|---|---|
| 9,989,905 | B2 | 6/2018 | Seki |
| 10,025,247 | B2 | 7/2018 | Sawada |
| 10,082,751 | B2 | 9/2018 | Seto |
| 10,168,653 | B2 | 1/2019 | Matsuda |
| 10,197,957 | B2 | 2/2019 | Fujimoto |
| 10,222,732 | B2 | 3/2019 | Seki |
| 10,241,448 | B2 | 3/2019 | Sawada |
| 10,281,850 | B2 | 5/2019 | Matsuda |
| 10,289,037 | B2 | 5/2019 | Seki |
| 10,295,937 | B2 | 5/2019 | Sawada |
| 10,295,939 | B2 | 5/2019 | Yoshinaga |
| 10,317,823 | B2 | 6/2019 | Fujimoto |
| 10,331,062 | B2 | 6/2019 | Yoshinaga |

(Continued)

FOREIGN PATENT DOCUMENTS

| | | |
|---|---|---|
| JP | 2014-238560 | 12/2014 |
| JP | 2015-194661 | 11/2015 |

(Continued)

*Primary Examiner* — Sophia S Chen
(74) *Attorney, Agent, or Firm* — Oblon, McClelland, Maier & Neustadt, L.L.P.

(57) ABSTRACT

A nip forming member includes a base material and a thermal conductive member that overlaps the base material and has a higher thermal conductivity than a thermal conductivity of the base material. The base material has protrusions projecting to one side or another side in a short direction on a part of a longitudinal direction on both sides in the short direction. The thermal conductive member has fitting holes into which the protrusions are fitted in both sides in the short direction.

6 Claims, 11 Drawing Sheets

(56) References Cited

U.S. PATENT DOCUMENTS

| | | | | |
|---|---|---|---|---|
| 2011/0116848 | A1* | 5/2011 | Yamaguchi | G03G 15/2064 399/329 |
| 2014/0056625 | A1* | 2/2014 | Naitoh | G03G 15/2053 399/329 |
| 2014/0064804 | A1* | 3/2014 | Yamaguchi | G03G 15/2053 399/329 |
| 2016/0252856 | A1* | 9/2016 | Suzuki | G03G 15/2053 399/329 |
| 2018/0095388 | A1* | 4/2018 | Uchiyama | G03G 15/2053 |
| 2018/0356754 | A1 | 12/2018 | Yoshinaga | |
| 2019/0258196 | A1 | 8/2019 | Iwaya | |
| 2019/0286025 | A1 | 9/2019 | Yamaguchi | |

FOREIGN PATENT DOCUMENTS

| | | |
|---|---|---|
| JP | 2017-167460 | 9/2017 |
| JP | 2018-010258 | 1/2018 |
| JP | 2018-013518 | 1/2018 |

* cited by examiner

NIP FORMING MEMBER, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-041223, filed on Mar. 7, 2019, in the Japan Patent Office, the entire disclosure of which is hereby incorporated by reference herein.

BACKGROUND

Technical Field

Embodiments of the present disclosure generally relate to a fixing device, an image forming apparatus, and a nip forming member, and more particularly, to a fixing device for fixing a toner image on a recording medium, an image forming apparatus for forming an image on a recording medium, and a nip forming member for sliding a fixing rotator that fixes an image on a recording medium.

SUMMARY

In one embodiment of the present disclosure, a novel nip forming member is described that includes a base material, a high thermal conductive member provided to overlap the base material and having a higher thermal conductivity than the base material. The base material has protrusions projecting to one side or the other side in the short direction on a part of the longitudinal direction on both sides in the short direction The high thermal conductive member has fitting holes into which the protrusions are fitted in both sides in the short direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EMBODIMENT OF THE DISCLOSURE

Figure 1:
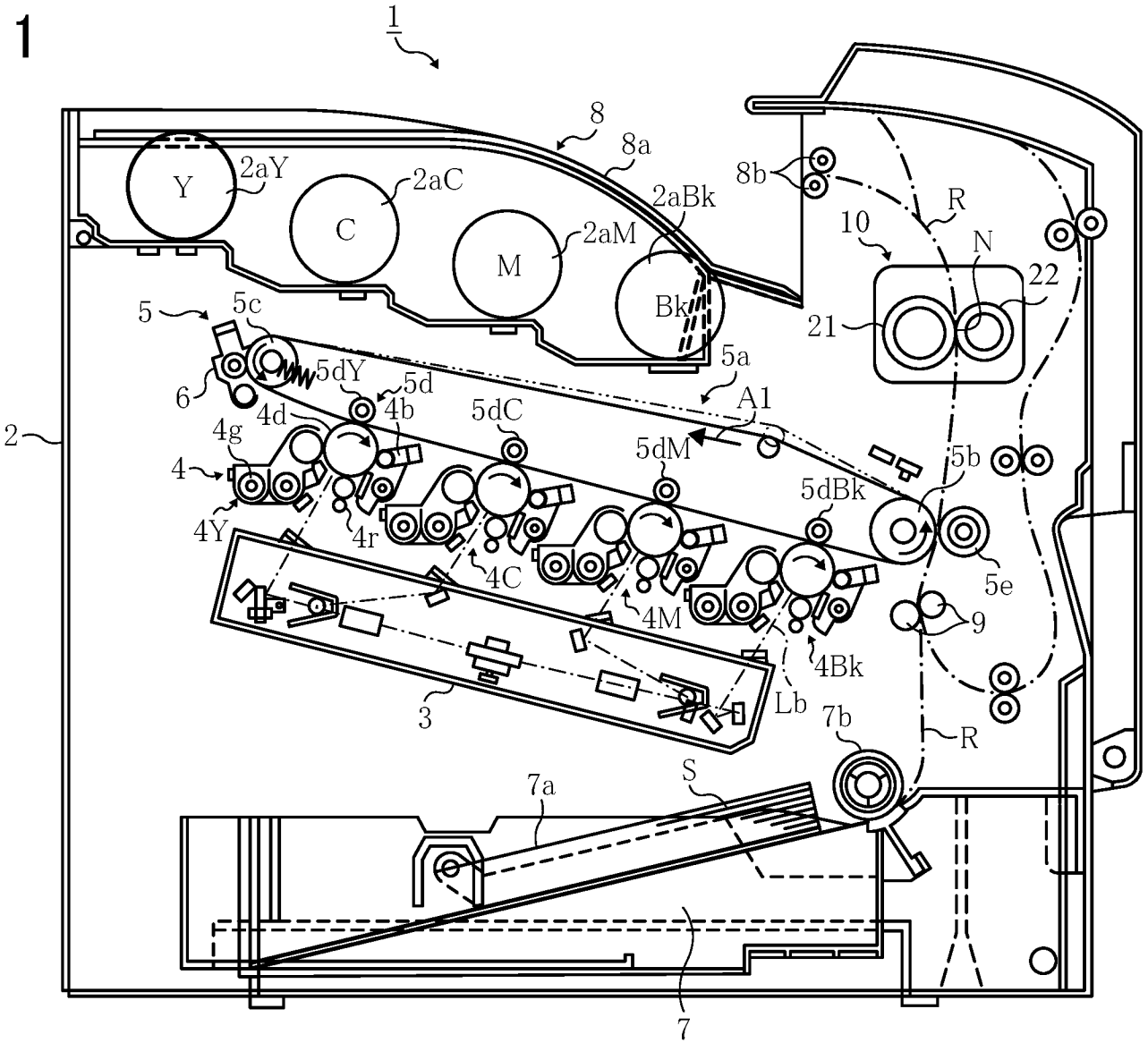
FIG. 1 is a schematic view of an image forming apparatus according to exemplary aspects of the present disclosure.

In describing exemplary embodiments illustrated in the drawings, specific terminology is employed for the sake of clarity. However, the disclosure of this patent specification is not limited by the specific terminology so selected and it is to be understood that each specific element includes all technical equivalents that have the same function, operate in a similar manner, and achieve similar results.

Although the embodiments are described in terms of technical features with reference to the attached drawings, such description is not limiting on the scope of the disclosure, and all of the components or elements described in the embodiments of the present disclosure are not necessarily indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and Bk denote colors yellow, cyan, magenta, and black, respectively. To simplify the description, these suffixes may be omitted unless necessary.

Referring now to the drawings, wherein like reference numerals designate identical or corresponding parts throughout the several views, embodiments of the present disclosure are described below.

Initially with reference to FIG. 1, a description is given of an image forming apparatus 1 according to an exemplary embodiment of the present disclosure.

FIG. 1 is a schematic view of the image forming apparatus 1.

The image forming apparatus 1 is a color printer that forms color and monochrome toner images on recording media by electrophotography.

As illustrated in FIG. 1, the image forming apparatus 1 includes a housing 2, an optical writing device 3, a process unit 4 as an image forming device, a transfer device 5, a belt cleaning device 6, a sheet feeding device 7, a sheet ejection unit 8, a registration roller pair 9, and a fixing device 10.

The image forming apparatus 1 has a tandem configuration, in which photoconductive drums 4*d* are arranged side by side, as image bearers to respectively bear toner images of yellow (Y), cyan (C), magenta (M), and black (Bk). It is to be noted that the image forming apparatus according to an exemplary embodiment of the present disclosure is not limited to such a tandem image forming apparatus, but may have another configuration. Additionally, the image forming apparatus according to an exemplary embodiment of the present disclosure is not limited to the color image forming apparatus 1, but may be another type of image forming apparatus. For example, the image forming apparatus may be a copier, a facsimile machine, or a multifunction peripheral having one or more capabilities of these devices.

The housing 2 accommodates various components. Also, inside the housing 2 is a conveyance passage R, defined by internal components of the image forming apparatus 1, along which a sheet S as a recording medium is conveyed from the sheet feeding device 7 to the sheet ejection unit 8.

The housing 2 also accommodates, e.g., toner bottles 2*a*Y, 2*a*C, 2*a*M, and 2*a*Bk below the sheet ejection unit 8. The removable toner bottles 2*a*Y, 2*a*C, 2*a*M, and 2*a*Bk, contain fresh toner of the colors yellow, cyan, magenta, and black, respectively, and are mounted in the housing 2. The housing 2 also accommodates a waste toner container having an inlet in communication with a toner conveyance tube. The waste toner container receives waste toner conveyed through the toner conveyance tube.

The optical writing device 3 includes a semiconductor laser as a light source, a coupling lens, an f-θ lens, a toroidal lens, a deflection mirror, and a polygon mirror. The optical writing device 3 emits laser beams Lb onto the respective photoconductive drums 4*d* included in the process unit 4, according to yellow, cyan, magenta, and black image data, to for electrostatic latent images on the respective photoconductive drums 4*d*. The yellow, cyan, magenta, and black image data are single-color data, into which a desired full-color image data is decomposed.

The process unit 4 includes of four sub-process units 4Y, 4C, 4M, and 4Bk to respectively form toner images of yellow, cyan, magenta, and black. For example, the sub-process unit 4Y includes the photoconductive drum 4*d*. The sub-process unit 4Y also includes a charging roller 4*r*, a developing device 4*g*, and a cleaning blade 4*b* surrounding the photoconductive drum 4 *d*. In the sub-process unit 4Y, charging, optical writing, developing, transfer, cleaning, and discharging processes are performed on the photoconductive drum 4*b* in this order.

Specifically, at first, the charging roller 4*r* charges an outer circumferential surface of the photoconductive drum 4*d* electrostatically. The optical writing device 3 conducts optical writing on the charged outer circumferential surface of the photoconductive drum 4*d*, forming an electrostatic latent image constituted of electrostatic patterns on the photoconductive drum 4*d*. Then, the developing device 4*g* adheres yellow toner supplied from the toner bottle 2*a*Y to the electrostatic latent image formed on the photoconductive drum 4*d*, thereby developing the electrostatic latent image with the yellow toner into a visible yellow toner image. The yellow toner image is primarily transferred onto the transfer device 5. Thereafter, the cleaning blade 4*b* removes residual toner, which failed to be transferred onto the transfer device 5 and therefore remaining on the photoconductive drum 4*d*, from the photoconductive drum 4*d*, rendering the photoconductive drum 4*d* to be ready for a next primary transfer. Finally, the discharging process is performed to remove residual static electricity from the photoconductive drum 4*d*.

The photoconductive drum 4*d* is a tube including a surface photoconductive layer made of organic and inorganic photoconductors. The charging roller 4*r* is disposed in proximity to the photoconductive drum 4*d* to charge the photoconductive drum 4*d* with discharge between the charging roller 4*r* and the photoconductive drum 4*d*.

The developing device 4*g* includes a supply section for supplying yellow toner to the photoconductive drum 4*d* and a developing section for adhering yellow toner to the photoconductive drum 4*d*. The cleaning blade 4*b* includes an elastic band made of, e.g., rubber, and a toner remover such as a brush. The removable developing device 4*g* is mounted in the housing 2.

Each of the sub-process units 4C, 4M, and 4Bk has a configuration equivalent to the configuration of the sub-process unit 4Y described above. Specifically, the sub-process units 4C, 4M, and 4Bk form toner images of cyan, magenta, and black to be primarily transferred onto the transfer device 5, respectively.

The transfer device 5 includes a transfer belt 5*a*, a driving roller 5*b*, a driven roller 5*c*, four primary transfer rollers 5*d*, and a secondary transfer roller 5*e*. The transfer belt 5*a* is an endless belt entrained around the driving roller 5*b* and the driven roller 5*c*. As the driving roller 5*b* and the driven roller 5*c* rotates, the transfer belt 5*a* rotates, or moves in cycles, in a rotational direction A1.

The four primary transfer rollers 5*d* are primary transfer rollers 5*d*Y, 5*d*C, 5*d*M, and 5*d*Bk pressed against the photoconductive drums 4*d* of the sub-process units 4Y, 4C, 4M, and 4Bk via the transfer belt 5*a*, respectively. Thus, the transfer belt 5*a* contacts the sub-process units 4Y, 4C, 4M, and 4Bk, forming four areas of contact, herein called primary transfer nips, between the transfer belt 5*a* and the sub-process units 4Y, 4C, 4M, and 4Bk, respectively. The secondary transfer roller 5*e* presses an outer circumferential surface of the transfer belt 5*a*, thereby pressing against the driving roller 5*b* via the transfer belt 5*a*. Thus, an area of contact, herein called a secondary transfer nip, is formed between the secondary transfer roller 5*e* and the transfer belt 5*a*.

The belt cleaning device 6 is disposed between the secondary transfer nip and the sub-process unit 4Y in the rotational direction A1 of the transfer belt 5*a*. The belt cleaning device 6 includes a toner remover and the toner conveyance tube. The toner remover removes residual toner, which failed to be transferred onto the sheet S at the secondary transfer nip and therefore remaining on the outer circumferential surface of the transfer belt 5*a*, from the transfer belt 5*a*. The residual toner thus removed is conveyed as waste toner through the toner conveyance tube to the waste toner container.

The sheet feeding device 7 is disposed in a lower portion of the housing 2. The sheet feeding device 7 includes a sheet tray 7*a* and a sheet feeding roller 7*b*. The sheet tray 7*a* holds a plurality of sheets S. The sheet feeding roller 7*b* picks up an uppermost sheet S from the plurality of sheets S on the sheet tray 7*a*, and feeds the uppermost sheet S to the conveyance passage R.

The sheet ejection unit 8 is disposed above the optical writing device 3 and atop the housing 2. The sheet ejection unit 8 includes a sheet ejection tray 8*a* and a sheet ejection roller pair 8*b*. The sheet ejection roller pair 8*b* ejects a sheet S bearing an image onto the sheet ejection tray 8*a*. Thus, the sheets S ejected from the conveyance passage R by the sheet ejection roller pair 8*b* rest one atop another on the sheet ejection tray 8*a*.

The registration roller pair 9 adjusts conveyance of the sheet S along the conveyance passage R, after the sheet S is fed by the sheet feeding roller 7*b* of the sheet feeding device 7.

For example, a registration sensor is interposed between the sheet feeding roller 7*b* and the registration roller pair 9 on the conveyance passage R inside the housing 2 to detect a leading edge of the sheet S conveyed along the conveyance passage R. When a predetermined time elapses after the registration sensor detects the leading edge of the sheet S, the registration roller pair 9 interrupts rotation to temporarily halt the sheet S that comes into contact with the registration roller pair 9. The registration roller pair 9 is timed to resume rotation while sandwiching the sheet S to convey the sheet S to the secondary transfer nip. For example, the registration roller pair 9 resumes rotation in synchronization with a composite color toner image, constituted of the toner images of yellow, cyan, magenta, and black superimposed one atop another on the transfer belt 5*a*, reaching the secondary transfer nip as the transfer belt 5*a* rotates in the rotation direction A1.

After the composite color toner image is transferred from the transfer belt 5*a* to the sheet S at the secondary transfer nip, the sheet S is conveyed to the fixing device 10. The fixing device 10 includes, e.g., a rotatable fixing belt 21 and a pressure roller 22 pressing against an outer circumferential surface of the fixing belt 21. The toner image is fixed onto the sheet S under heat and pressure while the sheet S is conveyed through an area of contact, herein called a fixing nip N, between the fixing belt 21 and the pressure roller 22. As the sheet S bearing the fixed toner image is discharged from the fixing nip N, the sheet S separates from the fixing belt 21 and is conveyed to the sheet ejection roller pair 8*b* along the conveyance passage R.

Figure 2:
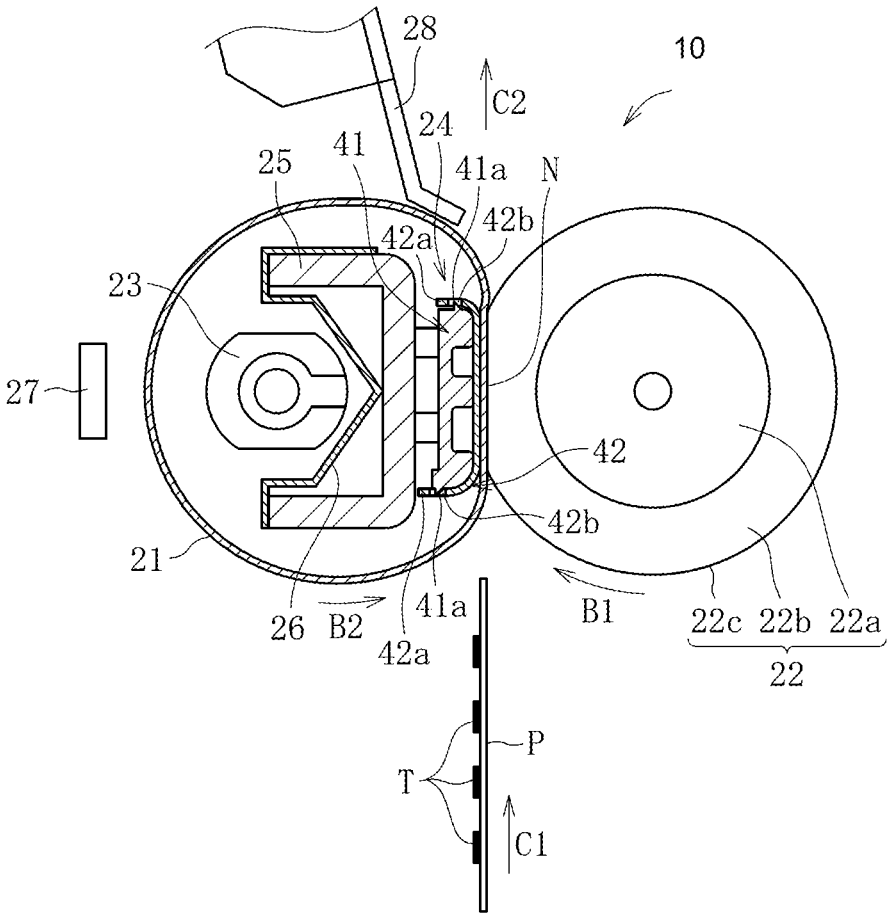
FIG. 2 is a schematic view of a fixing device according to exemplary aspects of the present disclosure.

Next, the basic configuration of the fixing device 10 will be described with reference to FIG. 2. As shown in FIG. 2, the fixing device 10 includes a fixing belt 21 as a rotatable belt member (or a fixing member), and a pressure roller 22 as an opposing member provided so as to be rotatable facing the fixing belt 21. A halogen heater 23 as a heating member for heating the fixing belt 21; a nip forming member 24 disposed inside the fixing belt 21; A stay 25 as a member, a reflection member 26 that reflects light emitted from the halogen heater 23 to the fixing belt 21, a temperature sensor 27 as temperature detecting means for detecting the temperature of the fixing belt 21, and a sheet from the fixing belt 21 Separating member28 and a pressure means for pressing the pressure roller 22 to the fixing belt 21.

The fixing belt 21 is composed of a thin and flexible endless belt member (including a film). Specifically, the fixing belt 21 includes a base material on the inner peripheral side formed of a metal material such as nickel or SUS or a resin material such as polyimide (PI), and a tetrafluoroethylene-perfluoroalkyl vinyl ether copolymer (PFA). Or it is comprised by the release layer of the outer peripheral side formed with polytetrafluoroethylene (PTFE) etc. Further, an elastic layer formed of a rubber material such as silicone rubber, foamable silicone rubber, or fluorine rubber may be interposed between the base material and the release layer.

The pressure roller 22 includes a cored bar 22*a*, an elastic layer 22*b* made of foamable silicone rubber, silicone rubber, or fluorine rubber provided on the surface of the cored bar 22*a*, and a PFA or PTFE provided on the surface of the elastic layer 22*c*. The pressure roller 22 is pressed toward the fixing belt 21 by a pressing unit and is in contact with the nip forming member 24 via the fixing belt 21. At the place where the pressure roller 22 and the fixing belt 21 are in pressure contact, the elastic layer 22*b* of the pressure roller 22 is crushed to form a nip portion N having a predetermined width. The pressure roller 22 is driven by a motor or the like provided in the printer body. It is configured to be rotationally driven by a source. When the pressure roller 22 is rotationally driven, the driving force is transmitted to the fixing belt 21 at the nip portion N, and the fixing belt 21 is driven to rotate.

In the present embodiment, the pressure roller 22 is a solid roller, but may be a hollow roller. In that case, a heating source such as a halogen heater may be disposed inside the pressure roller 22. In addition, when there is no elastic layer, the heat capacity is reduced and the fixability is improved, but when the unfixed toner is crushed and fixed, minute irregularities on the belt surface are transferred to the image, and uneven glossiness is formed on the solid portion of the image. In order to prevent this, an elastic layer having a thickness of 100 μm or more may be provided. By providing an elastic layer having a thickness of 100 μm or more, minute unevenness can be absorbed by elastic deformation of the elastic layer, so that occurrence of uneven gloss can be avoided. The elastic layer 22*b* may be solid rubber, but if there is no heat source inside the pressure roller 22, sponge rubber may be used. Sponge rubber is more preferable because heat insulation is enhanced and heat of the fixing belt 21 is less likely to be lost. Further, the fixing member and the facing member are not limited to being brought into pressure contact with each other, and may be configured to simply contact each other without applying pressure.

Both ends of the halogen heater 23 are fixed to the side plate of the fixing device 10. The halogen heater 23 is configured to generate heat by being output controlled by a power supply unit provided in the printer body, and the output control is performed based on the detection result of the surface temperature of the fixing belt 21 by the temperature sensor 27. By such output control of the heater 23, the temperature of the fixing belt 21 (fixing temperature) can be set to a desired temperature. In addition to the halogen heater, IH, a resistance heating element, a carbon heater, or the like may be used as a heating member for heating the fixing belt 21.

The nip forming member 24 has a longitudinal shape over the width direction of the fixing belt 21 or the axial direction of the pressure roller 22 (a direction perpendicular to the paper surface in FIG. 2, and this direction is hereinafter also referred to as a longitudinal direction of the nip forming member 24). And fixedly supported by the stay 25. Thus, the nip forming member 24 is prevented from being bent by the pressure of the pressure roller 22, and a uniform nip width is obtained over the axial direction of the pressure roller 22. The detailed configuration of the nip forming member 24 will be described later.

The stay 25 is arranged in a longitudinal shape over the longitudinal direction of the nip forming member 24. The stay 25 is in contact with the nip forming member 24 from the back side in the longitudinal direction, and supports the nip forming member 24 against the pressing force of the pressure roller 22. In order to satisfy the bending prevention function of the nip forming member 24, it is preferable to form the nip forming member 24 from a metal material having a high mechanical strength such as stainless steel or iron, but the stay 25 may be made of resin.

The reflection member 26 is disposed between the stay 25 and the halogen heater 23. In the present embodiment, the reflecting member 26 is fixed to the stay 25. Examples of the material of the reflecting member 26 include aluminum and stainless steel. By arranging the reflection member 26 in this way, the light emitted from the halogen heater 23 toward the stay 25 is reflected to the fixing belt 21. As a result, the amount of light applied to the fixing belt 21 can be increased, and the fixing belt 21 can be efficiently heated. Further, since it is possible to suppress the radiant heat from the halogen heater 23 from being transmitted to the stay 25 and the like, energy saving can be achieved.

Further, without providing the reflecting member 26 as in the present embodiment, the surface on the halogen heater 23 side of the stay 25 may be subjected to a mirror surface treatment such as polishing or painting to form a reflecting surface. The reflectance of the reflecting surface of the reflecting member 26 or the stay 25 is desirably 90% or more.

Since the shape and material of the stay 25 are restricted in order to ensure the strength, the choice of the shape and material is broadened when the reflective member 26 is separately provided as in the present embodiment. As can be appreciated, the reflective member 26 and the stay can each be specialized for their respective functions based shape and material choice. Further, since the reflecting member 26 is provided between the halogen heater 23 and the stay 25, the position of the reflecting member 26 with respect to the halogen heater 23 is reduced, so that the fixing belt 21 can be efficiently heated.

Further, in order to further improve the heating efficiency of the fixing belt 21 by light reflection, it is necessary to examine the direction of the reflecting surface of the reflecting member 26 or the stay 25. For example, when the reflecting member 26 is disposed concentrically with the halogen heater 23 as the center, the light is reflected toward the halogen heater 23, and the heating efficiency is reduced accordingly. On the other hand, when a part or all of the reflecting member 26 is disposed in a direction other than the halogen heater 23 to reflect light toward the fixing belt, the amount of light reflected toward the halogen heater 23 is reduced. Therefore, the heating efficiency by reflected light can be improved.

In addition, the fixing device 10 according to the present embodiment is devised in various configurations in order to further improve energy saving and first print time. Specifically, the fixing belt 21 can be directly heated by a halogen heater 23 at a place other than the nip portion N (direct heating method). In the present embodiment, nothing is interposed between the halogen heater 23 and the left portion of the fixing belt 21 in FIG. 2, and the radiant heat from the halogen heater 23 is directly applied to the fixing belt 21 in that portion.

Further, in order to reduce the heat capacity of the fixing belt 21, the fixing belt 21 is made thinner and smaller in diameter. Specifically, the thicknesses of the base material, the elastic layer, and the release layer constituting the fixing belt 21 are set in a range of 20 to 50 μm, 100 to 300 μm, and 10 to 50 μm, and the total thickness is set to 1 mm or less. The diameter of the fixing belt 21 is set to 20 to 40 mm. In order to further reduce the heat capacity, the thickness of the entire fixing belt 21 is desirably 0.2 mm or less, and more desirably 0.16 mm or less. The diameter of the fixing belt 21 is desirably 30 mm or less.

In this embodiment, the diameter of the pressure roller 22 is set to 20 to 40 mm, and the diameter of the fixing belt 21 and the diameter of the pressure roller 22 are configured to be equal. However, it is not limited to this configuration. For example, the fixing belt 21 may be formed so that the diameter thereof is smaller than the diameter of the pressure roller 22. In that case, since the curvature of the fixing belt 21 at the nip portion N is larger than the curvature of the pressure roller 22, the recording medium discharged from the nip portion N is easily separated from the fixing belt 21.

Hereinafter, the basic operation of the fixing device according to the present embodiment will be described with reference to FIG. 2. When the power switch of the printer body is turned on, power is supplied to the halogen heater 23 and the pressure roller 22 starts to rotate clockwise (see arrow B1) in FIG. 2. Accordingly, the fixing belt 21 is driven to rotate counterclockwise (see arrow B2) in FIG. 2.

Thereafter, the sheet P carrying the unfixed toner image T in the image forming process described above is conveyed in the direction of the arrow C1 in FIG. 2 while being guided by the guide plate. It is fed into the nip N of the pressure roller 22. Then, the toner image T is fixed on the surface of the paper P by heat from the fixing belt 21 heated by the halogen heater 23 and pressure applied between the fixing belt 21 and the pressure roller 22.

The paper P on which the toner image T is fixed is carried out from the nip portion N in the direction of the arrow C2 in FIG. 2. At this time, the paper P is separated from the fixing belt 21 by the leading edge of the paper P coming into contact with the leading edge of the separation member 28. Thereafter, the separated paper P is discharged out of the apparatus by the paper discharge roller as described above, and stocked on the paper discharge tray.

Next, a more detailed configuration of the nip forming member 24 will be described.

Figure 3:
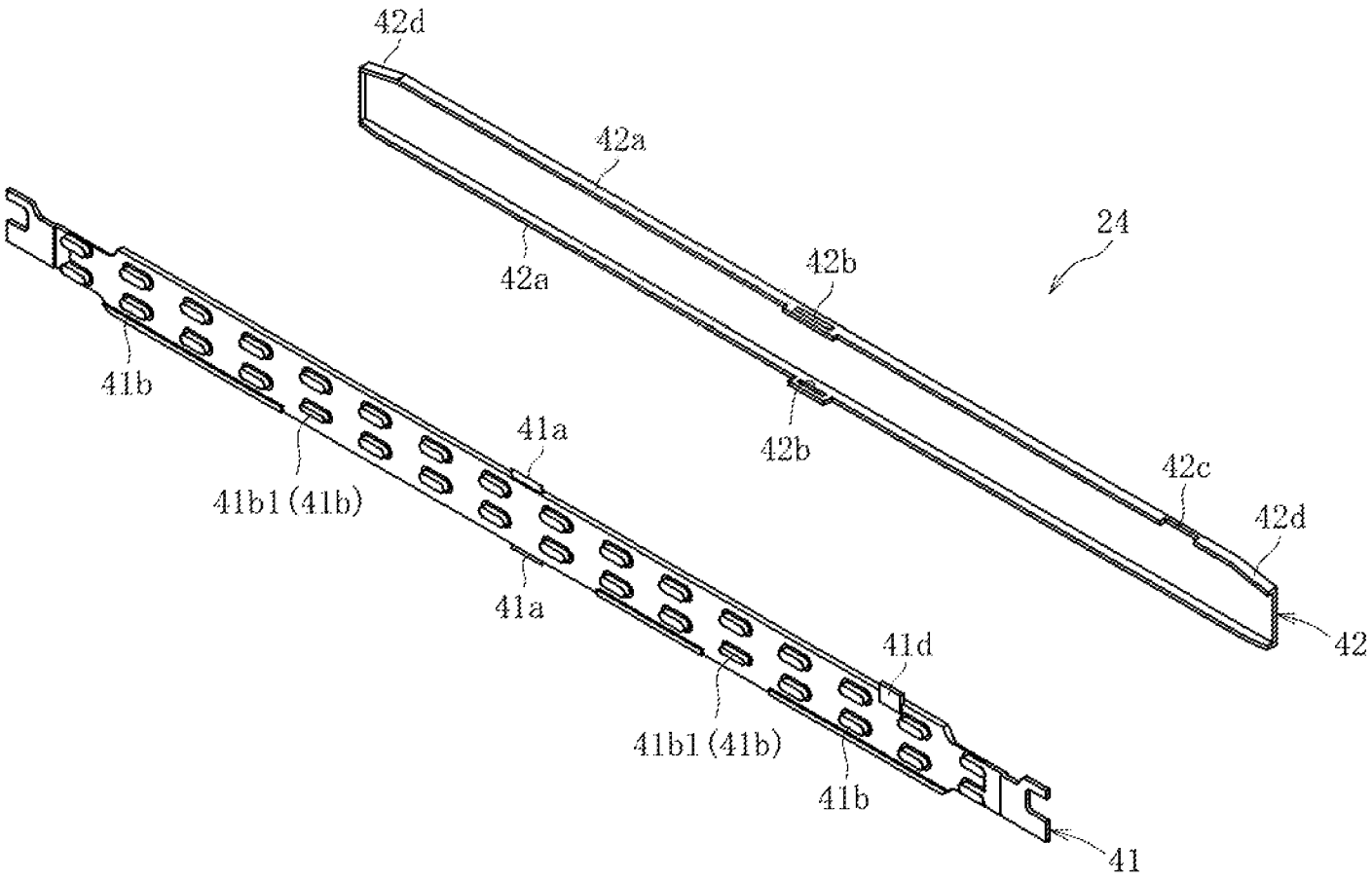
FIG. 3 is a view of a nip forming member according to exemplary aspects of the present disclosure.

As shown in FIGS. 2 and 3, the nip forming member 24 includes a base material 41 and a heat equalizing member 42 as a high heat conductive member. The base material 41 and the heat equalizing member 42 extend in the longitudinal direction of the nip forming member.

The base material 41 is composed of a heat-resistant member. For example, inorganic materials such as ceramic, glass and aluminum, rubbers such as silicone rubber and fluororubber, PTFE (tetrafluoroethylene), PFA (ethylene tetrafluoride). Fluororesin such as perfluoroalkoxy vinyl ether copolymer, ETFE (ethylene/tetrafluoroethylene copolymer), FEP (tetrafluoroethylene/hexafluoropropylene copolymer), PI (polyimide), PAI (polyamideimide), PPS (polyphenylene sulfide), PEEK (polyetheretherketone), LCP (liquid crystal plastic, liquid crystal polymer), resins such as phenol resin, nylon, aramid, or combinations thereof.

In this embodiment, the base material 41 is formed of a liquid crystal polymer (LCP) excellent in heat resistance and moldability, and the thermal conductivity is set to 0.54 W/m·K, for example.

The base material 41 has a protrusion 41*a* that fits with the heat equalizing member 42 (details will be described later). The protrusions 41*a* are provided so as to protrude in each direction in the short direction on both sides in the short direction at the center in the longitudinal direction of the base material 41.

As shown in FIG. 3, the base material 41 has a plurality of convex portions 41*b* that protrude toward the stay 25. A plurality of convex portions 41*b* arranged in the longitudinal direction of the base material 41 are provided in two rows in the lateral direction. The convex portion 41*b* is a positioning portion that contacts the stay 25 and positions the nip forming member 24 with respect to the stay 25.

The heat equalizing member 42 is a member that contacts the fixing belt 21 from the inner peripheral surface side (see FIG. 2). The heat equalizing member 42 is configured by a member having a higher thermal conductivity than the base material 41. Specifically, SUS is used in this embodiment, and its thermal conductivity is set to 16.7 to 20.9 W/m·K. A material having high thermal conductivity such as a copper-based material (for example, thermal conductivity 381 W/m·K) or an aluminum-based material (for example, thermal conductivity 236 W/m·K) can also be used.

A heat equalizing member 42 having good thermal conductivity is provided on the fixing belt 21 side of the nip forming member 24, and the heat equalizing member 42 is brought into contact with the fixing belt 21 in the width direction. As a result, the heat of the fixing belt 21 is moved in the width direction to be uniform, and temperature unevenness in the width direction of the fixing belt 21 can be suppressed.

The heat equalizing member 42 has bent portions 42*a* provided over the longitudinal direction on both sides in the short direction. As shown in FIG. 2, in this embodiment, the bent portion 42*a* of the heat equalizing member 42 is formed by bending a metal plate in both sides of the short side direction (top and bottom of the figure) and in a direction substantially perpendicular to the short side direction (In the left direction of the figure, the direction opposite to the nip N).

The heat equalizing member 42 has fitting holes 42*b* and 42*b* penetrating in the short direction on both sides in the short direction at the center in the longitudinal direction of the bent portions 42*a* and 42*a* (details will be described later).

The heat equalizing member 42 has constricted portions 42*d* whose width in the short-side direction becomes smaller toward the end portion on both ends in the longitudinal direction.

Next, how the base 41 and the heat equalizing member 42 are assembled by fitting the protrusion 41*a* into the fitting hole 42*b* will be described with reference to FIGS. 4 (*a*) and 4 (*b*).

Figure 4A:
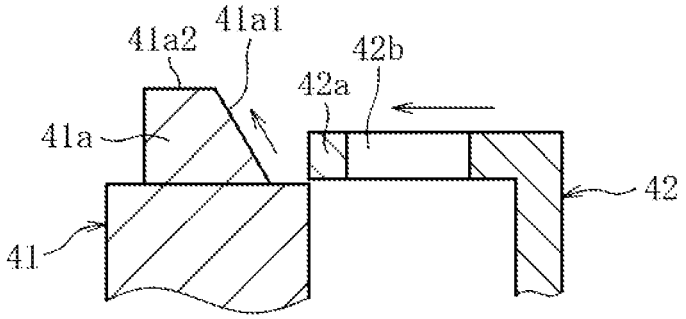
FIG. 4A is a first illustration of assembly of a heat equalizing member and a base material according to exemplary aspects of the present disclosure.

As shown in FIG. 4A, the protrusion 41*a* of the base material 41 is provided with an inclined surface 41*a*1 and a flat surface 41*a*2 as end surfaces on one side in the short direction. The inclined surface 41*a*1 is an inclined surface that is inclined from the fixing nip N side (right side in the figure) toward the opposite side to one side (upper side in the figure) in the lateral direction.

Figure 4B:
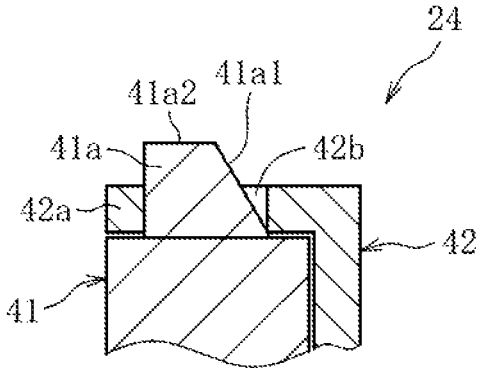
FIG. 4B is a second illustration of assembly of a heat equalizing member and a base material according to exemplary aspects of the present disclosure.

When the heat equalizing member 42 is moved in the left direction in the figure with respect to the base material 41 (see the arrow direction in the figure), the distal end portion of the bent portion 42*a* rides on the protruding portion 41*a* along the inclined surface 41*a*1. That is, the base material 41 in contact with the heat equalizing member 42 is elastically deformed, so that the bent portion 42*a* rides on the protruding portion 41*a*. Then, the heat equalizing member 42 further moves in the left direction in the drawing while elastically deforming the base material 41, and the tip of the bent portion 42*a* gets over the protruding portion 41*a*, so that the protrusion is fitted into the fitting hole 42*b* as shown in FIG. 4B.

By providing the inclined surface 41*a* on the upstream side of the protruding portion 41*a* in the mounting direction of the heat equalizing member 42, the bent portion 42*a* rides on the protruding portion 41*a* along this inclination (that is, the base material 41 is gradually elastically deformed). Therefore, the assembling property between the base material 41 and the heat equalizing member 42 is improved.

In the above description, the projection 41*a* on the one side in the short direction of the base material 41 and the heat equalizing member 42 and the fitting hole 42*b* are fitted. The protrusion 41*a* and the fitting hole 42*b* can be fitted. Thus, by fitting the protrusion 41*a* and the fitting hole 42*b*, the base material 41 and the heat equalizing member 42 can be fixed, and one can be prevented from falling off from the other.

Figure 5:
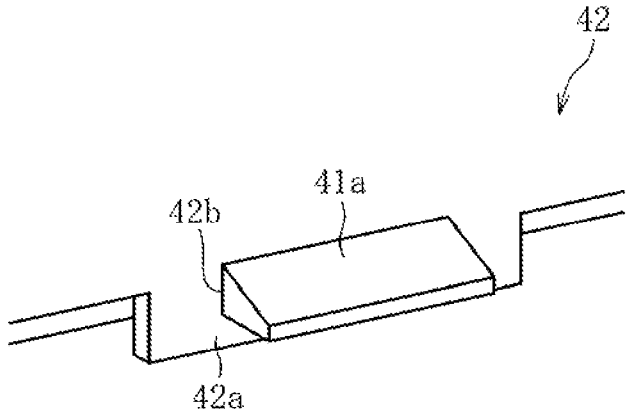
FIG. 5 is illustration of a mechanism to restrict longitudinal movement of the base material according to exemplary aspects of the present disclosure.

By fitting the projection 41*a* and the fitting hole 42*b* on both sides in the short direction, the movement of the base member 41 in the short direction relative to the heat equalizing member 42 is restricted. Further, as shown in FIG. 4B, the movement of the base material 41 in the thickness direction is restricted by the width of the fitting hole 42*b* in the horizontal direction in the drawing. Further, as shown in FIG. 5, the longitudinal movement of the base material 41 is restricted by the width in the longitudinal direction of the fitting hole 42*b* (the width in the horizontal direction in the figure). As described above, the movement of each direction of the base material 41 with respect to the soaking member 42 is restricted, and the base material 41 is positioned on the heat equalizing member 42. Actually, some backlash is provided between the protrusion 41*a* and the fitting hole 42*b* in consideration of a dimensional error or the like.

If the base material 41 and the heat equalizing member 42 are not sufficiently fixed and the position thereof is shifted, a portion that does not come into contact with the heat equalizing member 42 in the image forming region on the end side in the width direction of the fixing belt 21 occurs. As a result, the heat equalizing member 42 cannot exert a sufficient heat equalizing effect on the image forming area of the fixing belt 21. As a result, fixing failure of the image may occur. Further, when the heat equalizing member 42 is inclined with respect to the base material 41 and the shape of the fixing nip N is distorted, the separation position of the paper P that has passed through the fixing nip N from the fixing belt 21 is changed. It shifts in the width direction. This may cause paper wrinkles and jams. In this embodiment, such a malfunction can be prevented by positioning the base material 41 and the heat equalizing member 42 with high accuracy. In particular, since the base material 41 and the heat equalizing member 42 can be accurately positioned only by fitting the protrusion 41*a* and the fitting hole 42*b* as described above, the assembly time of these members can be shortened and good. Workability can be realized.

Figure 6:
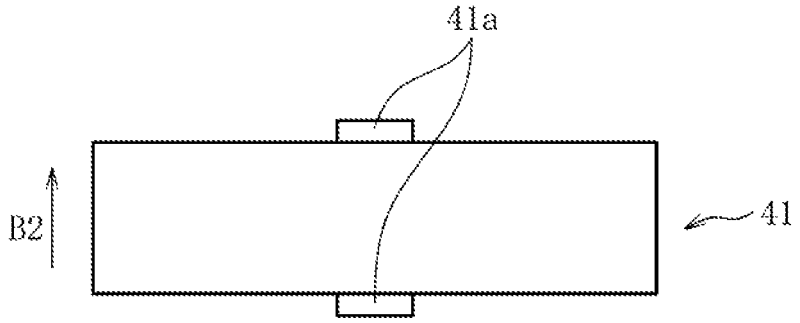
FIG. 6 is another illustration of the base material and a heat equalizing member assembly according to exemplary aspects of the present disclosure.

Further, in the present embodiment, as shown in FIG. 6, the protrusions 41*a* on both sides in the short direction are provided at substantially the same position in the longitudinal direction (left and right direction in the figure). Thereby, at the time of the assembly of the base material 41 and the heat equalizing member 42, the protrusions 41*a* and 41*a* on both sides in the short direction can be fitted into the fitting holes only by pressing a portion corresponding to the protrusion 41*a* in the longitudinal direction of the base material 41. Therefore, the workability of assembling the base material 41 and the heat equalizing member 42 is improved, and the work time can be shortened. In this embodiment, the projections 41*a* are provided at substantially the same position in the longitudinal direction. However, if the amount of deviation in the longitudinal direction of the protrusions 41*a* on both sides in the lateral direction is 30 mm or less, the pressing is performed once as described above. Thus, the protrusions 41*a* and 41*a* on both sides can be easily fitted into the fitting holes 42*b* and 42*b*.

Further, as in the present embodiment, the protrusion 41*a* and the fitting hole 42*b* are provided in the center in the longitudinal direction of the base material 41 and the heat equalizing member 42, whereby positioning in the center in the longitudinal direction can be performed. If it does so, it will become difficult to produce the position shift of the base material 41 and the heat equalizing member 42 to any one side of a longitudinal direction. Thereby, temperature unevenness in the longitudinal direction of the fixing belt 21 and pressure deviation in the longitudinal direction of the fixing nip can be suppressed as much as possible. In addition, the longitudinal direction center part of the base material 41 or the heat equalizing member 42 means the center area region when these members are divided into 3 in a longitudinal direction.

However, the arrangement of the protrusion 41*a* and the fitting hole 42*b* of the present invention is not limited to this. Hereinafter, a modified example of the arrangement of the protrusion 41*a* and the fitting hole 42*b* will be described with reference to FIG. 7. In the following drawings, only the base material 41 is shown, and the illustration of the heat equalizing member 42 is omitted, but it goes without saying that the fitting hole 42*b* is provided at a position corresponding to each protrusion 41*a*.

Figure 7A:
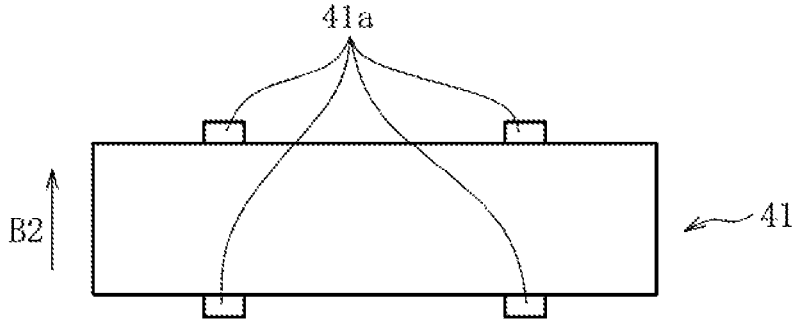
FIG. 7A is a further illustration of the base material and the heat equalizing member assembly according to exemplary aspects of the present disclosure.
Figure 7B:
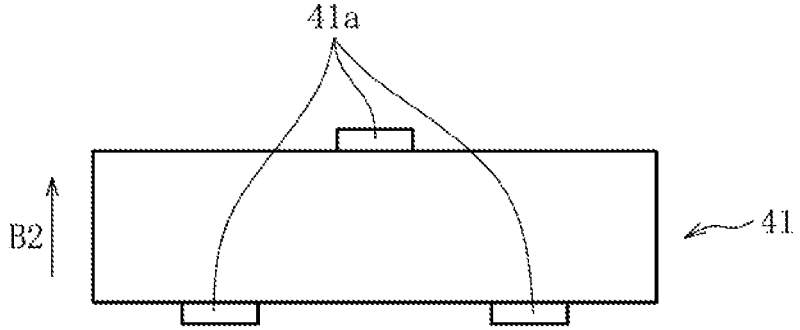
FIG. 7B is a still further illustration of the base material and the heat equalizing member assembly according to exemplary aspects of the present disclosure.

For example, as shown to FIG. 7 (*a*), the protrusion part 41*a* can be provided in the multiple places of a longitudinal direction on both sides of a transversal direction. By providing a plurality of fitting positions, even when a pressure is generated between the protrusion 41*a* and the fitting hole 42*b*, for example, when the fixing belt 21 rotates and a force in the arrow B2 direction is applied to the heat equalizing member 42 (that is, an abutting force is generated between the base material 41 and the heat equalizing member 42 on the upstream side in the arrow B2 direction), the load applied to each protrusion 41*a* and the fitting hole 42*b* can be dispersed. This is advantageous in terms of strength.

Moreover, as shown in FIG. 7 (*b*), the protrusion part 41*a* can also be positioned alternately in a longitudinal direction. As described above, when the heat equalizing member 42 is assembled to the base material 41, the protrusion 41*a* is pressed by the heat equalizing member 42, and this portion is elastically deformed. At this time, if the protrusion 41*a* is provided at the same position in the longitudinal direction on one side and the other side in the short direction, the deformation amount of the base material 41 at this portion increases. However, by shifting the arrangement of the protrusions 41*a* as in the present embodiment, it is possible to keep the amount of elastic deformation corresponding to one protrusion 41*a* at each position where the protrusions 41*a* in the longitudinal direction are provided. And the plastic deformation of the base material 41 can be suppressed. As described above, due to the rotation of the fixing belt 21 in the arrow B2 direction, a load is easily applied to the upstream portion (the lower portion in the figure) of the base material 41. Therefore, it is preferable to increase the number of the protrusions 41*a* on the upstream side than on the downstream side.

Figure 8:
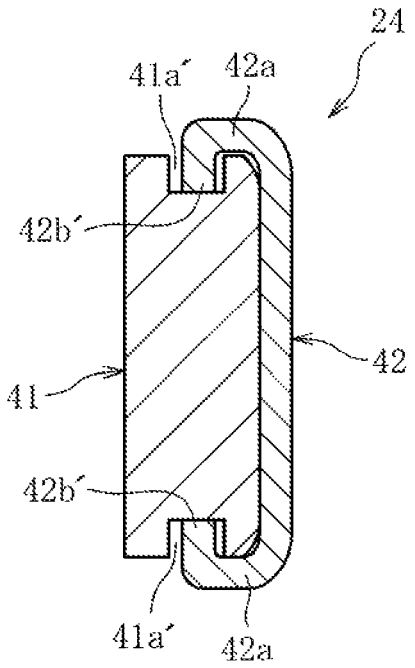
FIG. 8 is another illustration of the base material and the heat equalizing member assembly according to exemplary aspects of the present disclosure.

In the above embodiment, the protrusion 41*a* is provided on the base material 41 and the fitting hole 42*b* is provided on the heat equalizing member 42. However, the reverse may be possible. For example, as shown in FIG. 8, both sides in the short direction of the heat equalizing member 42 are bent in two stages, and extend toward the center in the short direction of the heat equalizing member 42 at the tip of a bent portion 42 an extending in the left direction in the figure. A protrusion 42*b*' is provided. A fitting hole 41*a*' for fitting the protruding portion 42*b*' is provided at a position corresponding to the protruding portion 42*b*' of the base material 41. Similar to the above-described embodiment, the protrusion 42*b*' and the fitting hole 41*a*' may be provided in a part in the longitudinal direction, a plurality of them may be provided, for example, only one may be provided in the central part in the longitudinal direction.

Also in the present embodiment, the protrusion 42*b*' is fitted into the fitting hole 41*a*', whereby the base material 41 and the heat equalizing member 42 can be fixed and the positional deviation can be prevented.

In the case where the protrusion 41*a* is provided on the base member 41 as in the above-described embodiment, if the protrusion 41*a* protrudes from the fitting hole 42*b* too much, the tip of the protrusion 41*a* slides on the fixing belt 21. The fixing belt 21 may be worn out. In order to prevent this wear, it is necessary to provide an extra space between the fixing belt 21 and the nip forming member 24. However, in the present embodiment, since the protrusion 42*b*' protrudes to the inside of the nip forming member 24, the fixing belt 21 and the protrusion 42*b*' do not slide. Thus, the space for the nip forming member 24 can be saved.

By the way, as shown in FIG. 2, the fixing belt 21 rotates from the bottom to the top. Due to this rotation, the heat equalizing member 42 that slides with the fixing belt 21 is pulled upward (downstream in the paper conveyance direction) in FIG. 2. The heat equalizing member 42 contacts the base material 41 on the upstream side in the paper conveyance direction (the lower side in FIG. 2).

Figure 9:
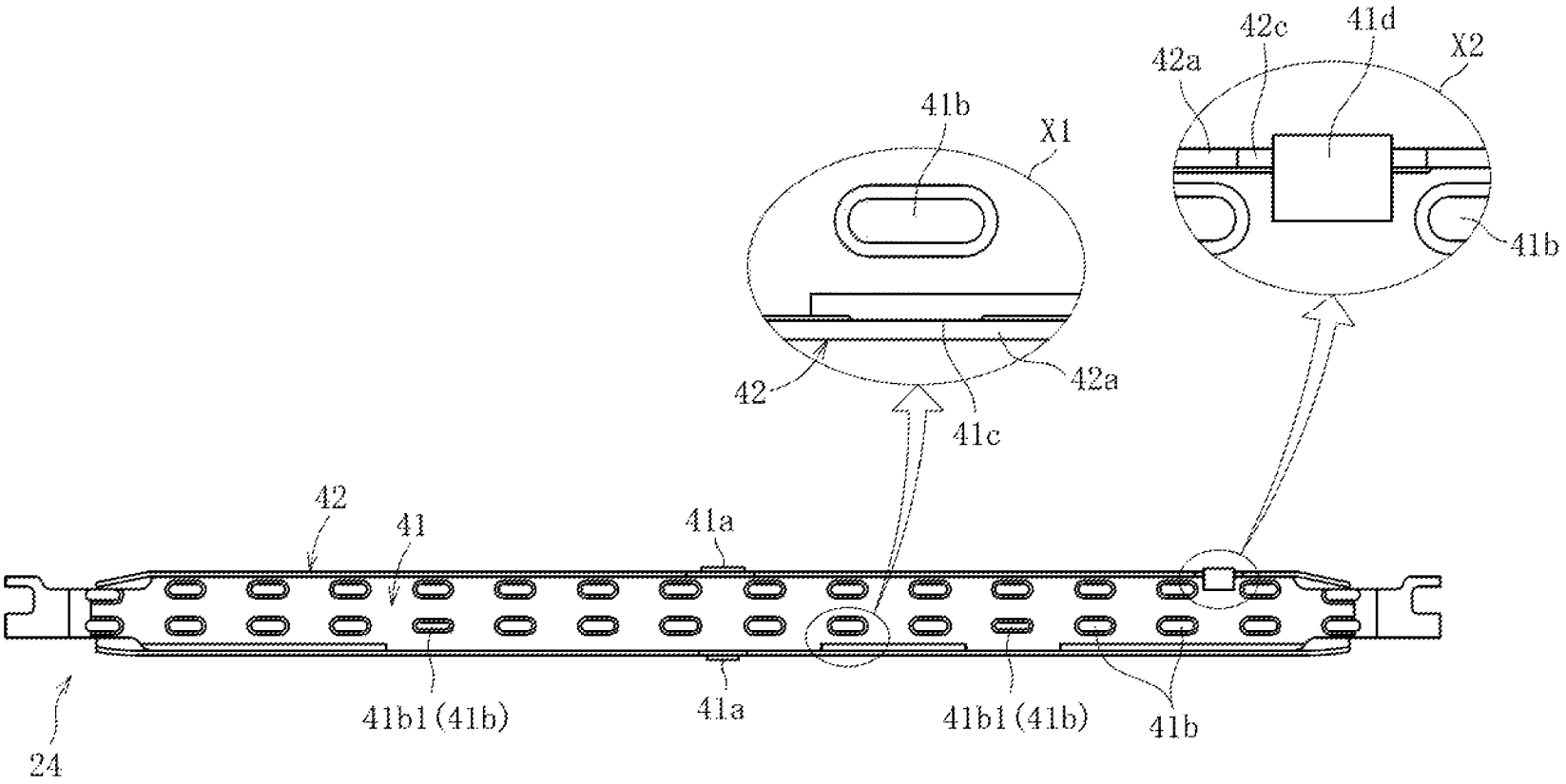
FIG. 9 is an illustration of a contact portion of a base material according to exemplary aspects of the present disclosure.

In contrast, in the present exemplary embodiment, as shown in an enlarged view X1 of FIG. 9, a contact portion 41*c* is provided on one side in the short side direction of the base material 41 and on the upstream side in the paper conveyance direction (lower side in FIG. 2). The abutting portion 41*c* is a portion that partially protrudes upstream in the paper transport direction in the longitudinal direction of the base material 41. It is provided in four places, the longitudinal direction both ends of the base material 41, and two places inside it. The two places on the inner side are the opposite sides of the position of the enlarged view X2 and the central portion in the longitudinal direction. As described above, by providing the projecting contact portion 41*c* that partially protrudes on the upstream side in the sheet conveyance direction, which is the contact side of the base material 41 with the heat equalizing member 42, the contact between the base material 41 and the heat equalization member 42 is achieved. The contact area is limited, and the contact area between the two can be reduced. Therefore, the heat of the heat equalizing member 42 is not easily taken away by the base material 41, and the heat loss of the fixing belt 21 can be reduced. Further, as in the present embodiment, by providing the contact portions 41*c* on both ends in the longitudinal direction, the base material 41 and the heat equalizing member 42 can be brought into contact with each other at the two most distant locations in the longitudinal direction. Both contact states are stabilized.

As shown in the enlarged view X2 of FIG. 9, the base material 41 is provided with a protruding portion 41*d* that protrudes downstream on the one side in the longitudinal direction on the downstream side in the paper conveyance direction (the other side in the short side).

As shown in the enlarged view X2 of FIG. 9, the base material 41 is provided with a protruding portion 41*d* that protrudes downstream on the one side in the longitudinal direction on the downstream side in the paper conveyance direction (the other side in the short side). Further, at a position corresponding to the protruding portion 41*d* of the heat equalizing member 42, a cutout portion 42*c* in which the bent portion 42*a* is partially cut out is provided. The protruding portion 41*d* is provided so as to protrude further downstream (upper side in the drawing) than the end edge of the heat equalizing member 42. The notch portion 42*c* is a relief portion for avoiding contact between the protruding portion 41*d* and the bent portion 42*a*.

The protruding portion 41*d* and the cutout portion 42*c* function as a misassembly prevention mechanism for the base material 41 and the heat equalizing member 42. That is, even when the base member 41 is attached to the heat equalizing member 42 by being reversed in either the top or bottom direction and the front and back directions in FIG. 9, the protruding portion 41*d* is not disposed at the position of the notch portion 42*c*. The protruding portion 41*d* cannot contact the bent portion 42*a* of the heat equalizing member 42 to assemble them, and assembly in different directions can be prevented.

In particular, in the present embodiment, a portion protruding from the base material 41 is provided and the heat equalizing member 42 has a shape in which a part thereof is cut out, so that the change of the member on the heat equalizing member 42 side can be minimized. Thereby, the difference in the heat capacity between the left and right of the heat equalizing member 42 can be kept to a minimum. Accordingly, it is possible to prevent erroneous assembly without providing as much bias as possible to the heat equalizing effect of the fixing belt 21 by the heat equalizing member 42.

In addition, as described above, the rotation of the fixing belt 21 causes a large contact force between the base material 41 and the heat equalizing member 42 on the upstream side in the paper transport direction, while transporting between the two on the downstream side in the paper transport direction. Since it is easy to create a gap in the direction, it is advantageous in terms of strength to provide a notch in the heat equalizing member 42 on the downstream side.

Figure 10:
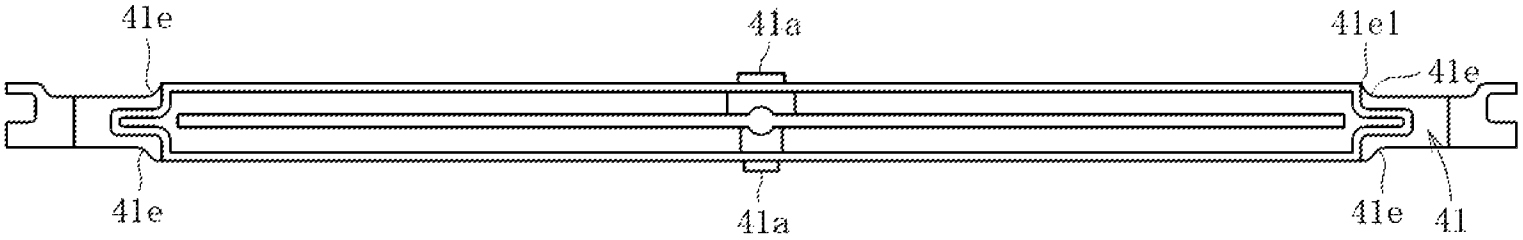
FIG. 10 is an illustration of a surface of the base material according to exemplary aspects of the present disclosure.

FIG. 10 is a view showing a surface of the base material 41 on the heat equalizing member 42 side. As shown in FIG. 10, the base material 41 is provided with a narrowed portion 41*e* whose width in the short direction is reduced on both sides in the longitudinal direction.

Figure 11:
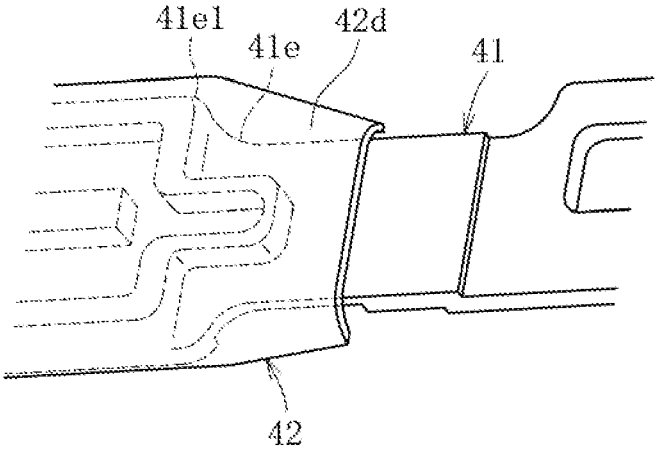
FIG. 11 is an illustration of a portion of the heat equalizing member according to exemplary aspects of the present disclosure.

As shown in FIG. 11, the heat equalizing member 42 is provided with a narrowed portion 42*d* having a curved section in the longitudinal direction, thereby preventing both ends of the heat equalizing member 42 in the longitudinal direction from becoming corners. When this portion and the fixing belt 21 slide, it is possible to prevent the fixing belt 21 from being scraped or worn. Moreover, the base material 41 can be accommodated in the throttle part 42*d* of the heat equalizing member 42 by providing the base part 41 with the throttle part 41*e* and reducing the width in the lateral direction on the end side.

Furthermore, in the present embodiment, the peripheral portion of the starting point 41*e*1 (boundary between the curved surface portion and the flat surface portion) of the throttle portion 41*e* of the base material 41 can be brought into contact with the inner surface of the throttle portion 42*d* of the heat equalizing member 42. The longitudinal movement of the material 41 with respect to the heat equalizing member 42 is restricted.

Next, the attachment structure of the nip forming member 24 to the stay 25 will be described with reference to FIG. 12. The nip forming member 24 is attached to the stay 25 in the direction of the arrow in the figure.

Figure 12:
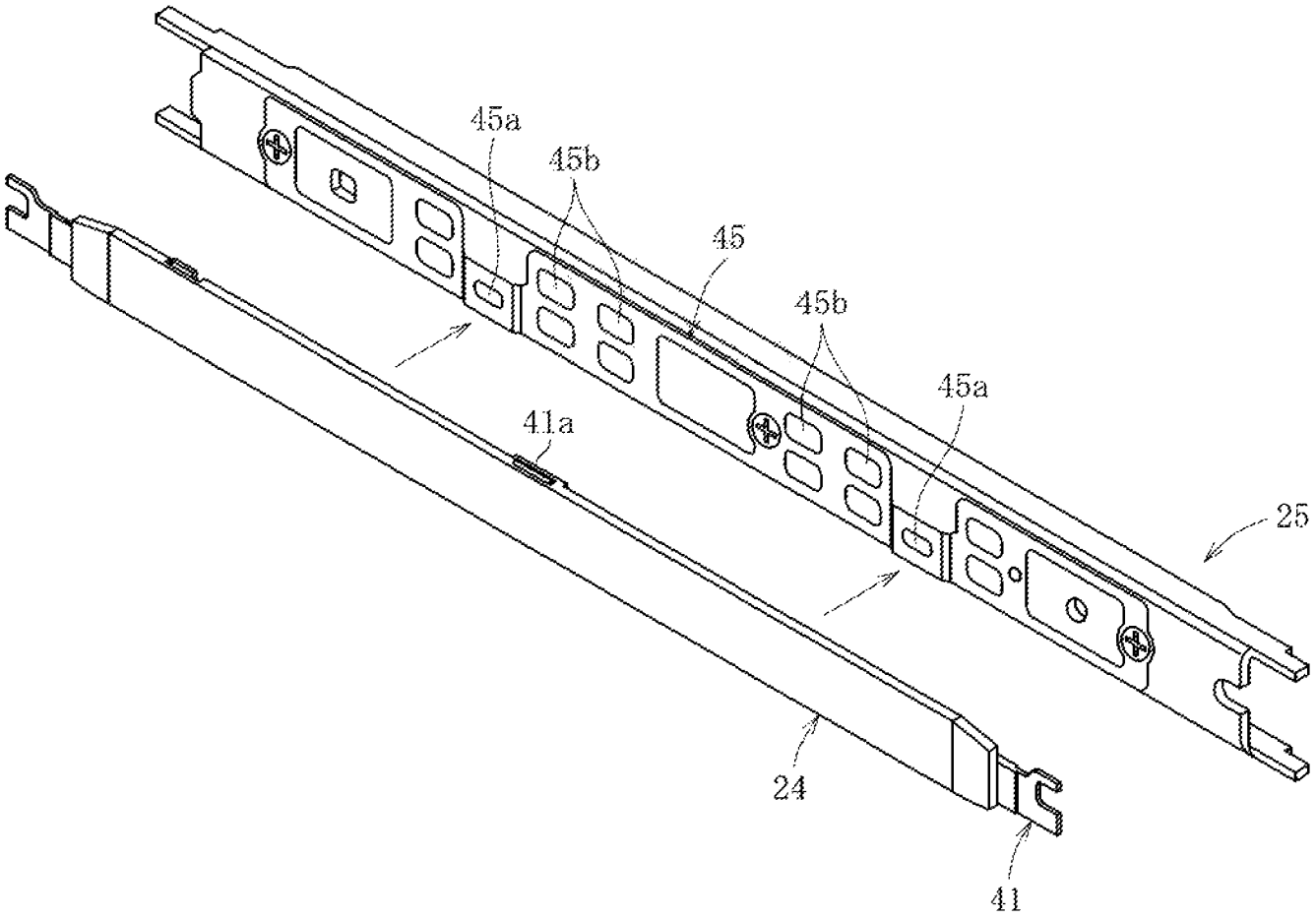
FIG. 12 is an illustration of attachment of a nip forming member to a stay according to exemplary aspects of the present disclosure.

As shown in FIG. 12, in the stay 25, a holding member 45 for holding the nip forming member 24 is fixed to a surface on the nip forming member 24 side.

The holding member 45 includes a holding hole 45*a* for holding the base material 41 and a plurality of hole portions 45*b* provided at positions corresponding to the convex portions 41*b* (see FIG. 9) of the base material 41. The portion of the holding member 45 in which the holding hole 45*a* is provided has a stepped shape that protrudes toward the nip forming member 24 one step from the other portions of the holding member 45.

Figure 13:
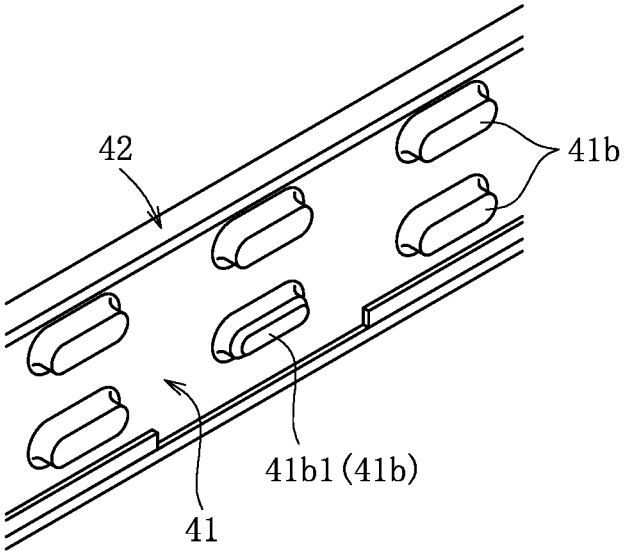
FIG. 13 is an illustration of a plurality of protrusions dispose on a base material according to exemplary aspects of the present disclosure.

As shown in FIGS. 9 and 13, among the plurality of protrusions 41*b* provided on the base material 41, the protrusion 41*b*1 inserted into the holding hole 45*a* of the holding member 45 has a C surface on the end face on the holding member 45 side (see FIG. 13). Therefore, the convex portion 41*b*1 can be smoothly inserted into the holding hole 45*a*. The other convex portion 41*b* is a positioning portion that penetrates the hole 45*b* of the holding member 45 and contacts the stay 25 to position the nip forming member 24 with respect to the stay 25.

The embodiment of the present invention has been described above, but the present invention is not limited to the above-described embodiment, and it is needless to say that various modifications can be made without departing from the gist of the present invention.

Figure 14:
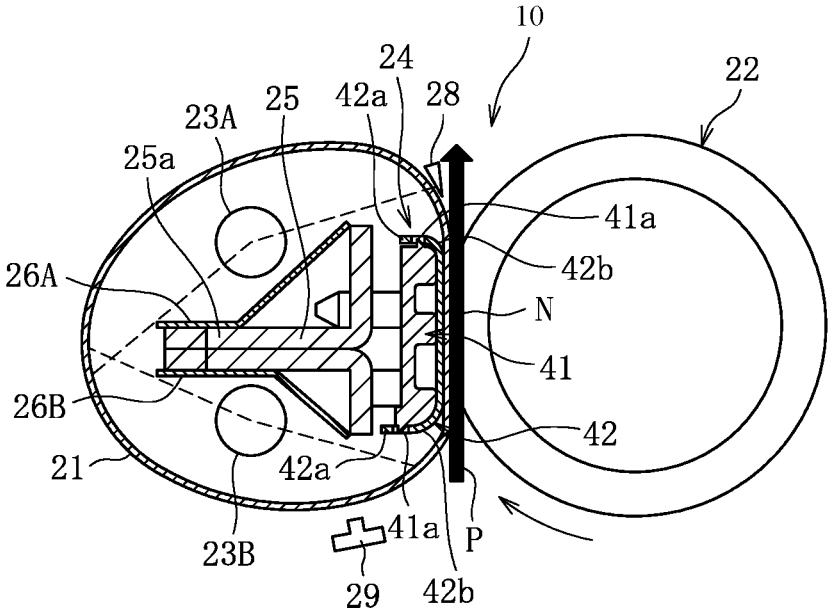
FIG. 14 is an illustration of a fixing device according to exemplary aspects of the present disclosure.

The nip forming member of the present invention can also be applied to the fixing device 10 including a plurality of heating members shown in FIG. 14. The following description will focus on the differences from the above-described fixing device of FIG. 2.

As shown in FIG. 14, the fixing device 10 includes a fixing belt 21 as a belt member, a pressure roller 22, a nip forming member 24, and the like, as in the above-described embodiment. Further, the fixing device 10 of the present embodiment has two heaters 23A and 23B. One of the heaters 23A and 23B has a heat generation region at the center in the longitudinal direction corresponding to the small size paper, and the other has heat generation regions at both ends in the longitudinal direction corresponding to the large size paper. In this embodiment, halogen heaters are used as the heaters 23A and 23B, but an induction heating device, a resistance heating element, a carbon heater, or the like may be used.

The stay 25 provided in the fixing device 10 has a T-shaped cross section, and has an upright portion 25*a* that stands upright on the side opposite to the fixing nip N side. The heaters 23A and 23B are separated by the upright portion 25*a*.

The heaters 23A and 23B are configured to generate heat under output control by a power supply unit provided in the printer main body. The output control is performed based on the temperature detection result of the belt surface by the temperature sensor provided on the outer periphery of the fixing belt 21. By such heater output control, the temperature of the fixing belt 21 (fixing temperature) can be set to a desired temperature.

Reflecting members 26A and 26B are disposed between the stay 25 and the heaters 23A and 23B, so that the heating efficiency of the heaters 23A and 23B to the fixing belt 21 is increased and the stay 25 is heated by the radiant heat from the heaters 23A and 23B. This reduces wasteful energy consumption.

The nip forming member 24 having the above-described configuration can also be applied to the fixing device described above. Thereby, the base material 41 and the heat equalizing member 42 can be positioned with high accuracy, and problems such as an image fixing failure and a jam during paper conveyance can be prevented.

The image forming apparatus according to the present invention is not limited to the color image forming apparatus shown in FIG. 1, but may be a monochrome image forming apparatus, a copying machine, a printer, a facsimile, or a complex machine thereof.

Recording media include paper P (plain paper), thick paper, postcards, envelopes, thin paper, coated paper (coated paper, art paper, etc.), tracing paper, overhead projector (OHP) sheet, plastic film, prepreg, copper foil, etc. included.

In the above embodiment, the case where the nip forming member of the present invention is applied to the fixing device provided in the image forming apparatus is exemplified. However, the nip forming member of the present invention can also be applied to a drying device for drying an object to be dried. For example, in an ink jet image forming apparatus, an image ink formed on the surface of a recording medium such as paper.

Obviously, numerous modifications and variations of the present invention are possible in light of the above teachings. It is therefore to be understood that within the scope of the appended claims, the invention may be practiced otherwise than as specifically described herein

What is claimed is:

1. A nip forming member comprising:

a base material;

a thermal conductive member provided to overlap the base material and having a higher thermal conductivity than a thermal conductivity of the base material;

the base material includes protrusions projecting to one side or another side in a short direction on a part of a longitudinal direction on both sides in the short direction;

and the thermal conductive member includes fitting holes into which the protrusions are fitted in both sides in the short direction, wherein the protrusions are alternated with one side and the other side in the short-side direction of the base material, and a number of protrusions on an upstream side of the base material in a rotation direction of a fixing belt in contact with the base material is greater than a number of protrusions on a downstream side.

2. The nip forming member according to claim 1, wherein a plurality of the protrusions and the fitting holes are provided in a longitudinal direction of the base material or the thermal conductive member.

3. The nip forming member according to claim 1, the protrusions have an inclined surface on a downstream side in a fitting direction with respect to the fitting hole, and a protrusion height of the protrusions increases from a downstream side to an upstream side in the fitting direction.

4. A fixing device comprising:

a fixing member, an opposing member, the nip forming member according to claim 1, wherein a fixing nip is formed between the fixing member and the opposing member.

5. An image forming apparatus comprising the fixing device according to claim 4.

6. The fixing device according to claim 4, wherein the fixing member is a fixing belt.

* * * * *